US008912734B2

(12) United States Patent
Melanson et al.

(10) Patent No.: US 8,912,734 B2
(45) Date of Patent: Dec. 16, 2014

(54) COLOR MIXING OF ELECTRONIC LIGHT SOURCES WITH CORRELATION BETWEEN PHASE-CUT DIMMER ANGLE AND PREDETERMINED BLACK BODY RADIATION FUNCTION

(71) Applicant: Cirrus Logic, Inc., Austin, TX (US)

(72) Inventors: John L. Melanson, Austin, TX (US); Alfredo R. Linz, Austin, TX (US); Michael A. Kost, Austin, TX (US); Sahil Singh, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 15 days.

(21) Appl. No.: 13/673,879

(22) Filed: Nov. 9, 2012

(65) Prior Publication Data

US 2013/0069561 A1 Mar. 21, 2013

Related U.S. Application Data

(63) Continuation-in-part of application No. 13/430,601, filed on Mar. 26, 2012.

(60) Provisional application No. 61/558,529, filed on Nov. 11, 2011, provisional application No. 61/600,330, filed on Feb. 17, 2012, provisional application No. 61/467,258, filed on Mar. 24, 2011, provisional application No. 61/532,980, filed on Sep. 9, 2011.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0863* (2013.01); *H05B 33/0866* (2013.01); *H05B 33/0872* (2013.01); *H05B 33/0815* (2013.01)

USPC ..... 315/297; 315/192; 315/193; 315/301; 315/307

(58) Field of Classification Search

None

See application file for complete search history.

(56) References Cited

U.S. PATENT DOCUMENTS 4,409,476 A 10/1983 Lofgren et al.
6,016,038 A 1/2000 Mueller et al.

(Continued)

FOREIGN PATENT DOCUMENTS

EP 1528785 4/2005
EP 1589519 A2 10/2005

(Continued)

OTHER PUBLICATIONS

Linear Technology, News Release, Data Sheet LT3496, Triple Output LED Driver Drives Up to 24 x 500mA LEDs & Offers 3,000:1 True Color PWM Dimming, 2007, pp. 1-2, Milpitas, CA, USA.

(Continued)

*Primary Examiner* — Anh Tran

(74) *Attorney, Agent, or Firm* — Terrile, Cannatti, Chambers & Holland, LLP; Kent B. Chambers

(57) ABSTRACT

A lighting system includes methods and systems to mix colors of light emitted from at least two LED emitters. In at least one embodiment, the lighting system includes a controller that responds to phase-cut angles of the dimming signal and correlates the phase-cut angles with a predetermined black body radiation function to dynamically adjust a color spectra of the mixed light in response to changes in phase cut angles of the phase-cut dimming level signal. In at least one embodiment, the controller utilizes the predetermined black body radiation function to dynamically adjust the color spectra of the mixed, emitted light in response to changes in phase cut angles of a phase-cut dimming level signal. In at least one embodiment, the predetermined black body radiation function specifies correlated color temperatures (CCTs) that model the CCTs of an actual non-LED based lamp, such as an incandescent lamp.

37 Claims, 13 Drawing Sheets

(56) References Cited

U.S. PATENT DOCUMENTS

| | | | | |
|---|---|---|---|---|
| 6,150,744 | A | 11/2000 | Onishi | |
| 6,211,620 | B1 | 4/2001 | Gyoten et al. | |
| 6,211,626 | B1 | 4/2001 | Lys et al. | |
| 6,369,525 | B1 | 4/2002 | Chang et al. | |
| 6,441,558 | B1 | 8/2002 | Muthu et al. | |
| 6,495,964 | B1 | 12/2002 | Muthu et al. | |
| 6,583,550 | B2 | 6/2003 | Iwasa et al. | |
| 6,636,003 | B2 | 10/2003 | Rahm et al. | |
| 6,688,753 | B2 | 2/2004 | Calon et al. | |
| 6,753,661 | B2 | 6/2004 | Muthu et al. | |
| 6,756,772 | B2 | 6/2004 | McGinnis | |
| 6,788,011 | B2 | 9/2004 | Mueller et al. | |
| 6,888,322 | B2 | 5/2005 | Dowling et al. | |
| 6,958,920 | B2 | 10/2005 | Mednik et al. | |
| 6,967,448 | B2 | 11/2005 | Morgan et al. | |
| 6,975,079 | B2 | 12/2005 | Lys et al. | |
| 7,064,498 | B2 | 6/2006 | Dowling et al. | |
| 7,079,791 | B2 | 7/2006 | Chang | |
| 7,088,059 | B2 | 8/2006 | McKinney et al. | |
| 7,116,294 | B2 | 10/2006 | Stopa | |
| 7,135,824 | B2 | 11/2006 | Lys et al. | |
| 7,213,940 | B1 | 5/2007 | VanDe Ven et al. | |
| 7,246,919 | B2 | 7/2007 | Porchia et al. | |
| 7,255,457 | B2 | 8/2007 | Ducharme et al. | |
| 7,288,902 | B1 | 10/2007 | Melanson | |
| 7,375,476 | B2 | 5/2008 | Walter et al. | |
| 7,498,753 | B2 | 3/2009 | McAvoy | |
| 7,511,437 | B2 | 3/2009 | Lys et al. | |
| 7,649,326 | B2 | 1/2010 | Johnson et al. | |
| 7,804,478 | B2 | 9/2010 | Schou | |
| 2002/0145041 | A1 | 10/2002 | Muthu et al. | |
| 2003/0057886 | A1 | 3/2003 | Lys et al. | |
| 2003/0085749 | A1 | 5/2003 | Xu et al. | |
| 2004/0085030 | A1 | 5/2004 | LaFlamme et al. | |
| 2004/0105261 | A1 | 6/2004 | Ducharme et al. | |
| 2004/0169477 | A1 | 9/2004 | Yanai | |
| 2004/0212321 | A1 | 10/2004 | Lys et al. | |
| 2005/0218838 | A1 | 10/2005 | Lys et al. | |
| 2005/0231459 | A1 | 10/2005 | Furukawa | |
| 2005/0243022 | A1 | 11/2005 | Negru | |
| 2005/0253533 | A1* | 11/2005 | Lys et al. | 315/224 |
| 2006/0023002 | A1 | 2/2006 | Haea et al. | |
| 2006/0125420 | A1 | 6/2006 | Boone et al. | |
| 2006/0226795 | A1 | 10/2006 | Walter et al. | |
| 2006/0232219 | A1 | 10/2006 | Xu | |
| 2007/0029946 | A1 | 2/2007 | Yu et al. | |
| 2007/0126656 | A1 | 6/2007 | Huang et al. | |
| 2007/0195526 | A1 | 8/2007 | Dowling et al. | |
| 2007/0211013 | A1 | 9/2007 | Uehara et al. | |
| 2007/0262724 | A1 | 11/2007 | Mednik et al. | |
| 2008/0012502 | A1 | 1/2008 | Lys | |
| 2008/0018261 | A1 | 1/2008 | Kastner | |
| 2008/0054815 | A1 | 3/2008 | Kotikalapoodi et al. | |
| 2008/0116818 | A1 | 5/2008 | Shteynberg et al. | |
| 2008/0150433 | A1 | 6/2008 | Tsuchida et al. | |
| 2008/0224631 | A1 | 9/2008 | Melanson | |
| 2008/0224635 | A1 | 9/2008 | Hayes | |
| 2009/0184616 | A1 | 7/2009 | Van De Ven et al. | |
| 2009/0218960 | A1 | 9/2009 | Lyons et al. | |
| 2011/0001440 | A1* | 1/2011 | Deurenberg et al. | 315/307 |
| 2012/0146519 | A1* | 6/2012 | Briggs | 315/192 |

FOREIGN PATENT DOCUMENTS

| | | | |
|---|---|---|---|
| WO | 02/091805 | A2 | 11/2002 |
| WO | 2007/026170 | A2 | 3/2007 |
| WO | 20070093938 | A1 | 8/2007 |
| WO | 2006/067521 | A1 | 6/2008 |
| WO | 2008/072160 | A1 | 6/2008 |
| WO | 2010/016002 | A1 | 2/2010 |
| WO | WO2010016002 | A1 | 2/2010 |
| WO | 2011/048214 | A1 | 4/2011 |
| WO | WO2011048214 | A1 | 4/2011 |
| WO | 2011/061505 | A1 | 5/2011 |

OTHER PUBLICATIONS

International Search Report and Written Opinion of the International Searching Authority dated May 14, 2013, issued in the corresponding PCT Application No. PCT/US2012/064543, 12 pages.

Chromacity Shifts in High-Power White LED Systems Due toDifferent Dimming Methods, Solid-State Lighting, 2005, pp. 1-2, http://www.lrc.rpi.edu/programs/solidstate/completedprojects.asp?ID=76, printed May 3, 2007.

Color Temperature, Sizes, Inc., www.sizes.com/units/color_temperature.htm, Oct. 10, 2002, pp. 1-3, printed Mar. 27, 2007.

Linear Technology, News Release, Data Sheet LT3496, Triple Output LED Driver Drives Up to 24×500mA LEDs & Offers 3,000:1 True Color PWM Dimming, 2007, pp. 1-2, Milpitas, CA, USA.

C. Dilouie, Introducing the LED Driver, Electrical Construction & Maintenance (EC&M), Sep. 1, 2004, pp. 28-30, Zing Communications, Chicago, IL, USA.

Wikipedia, Light Emitting Diode, http://er.wikipedia.org/wiki/Light-emiting_diode, Mar. 2007, pp. 1-16, printed Mar. 27, 2007.

Y. Ohno, Spectral Design Considerations for White LED Color Rendering, Final Manuscript, Optical Engineering, Nov. 30, 005, pp. 1-20, vol. 44, 111302, Special Section on Solid State Lighting, National Institute of Standards and Technology, Gaithersburg, MD, USA.

International Preliminary Report on Patentability, PCT/US2012/064543, European Patent Office, May 13, 2014, pp. 1-8.

* cited by examiner

COLOR MIXING OF ELECTRONIC LIGHT SOURCES WITH CORRELATION BETWEEN PHASE-CUT DIMMER ANGLE AND PREDETERMINED BLACK BODY RADIATION FUNCTION

CROSS-REFERENCE TO RELATED APPLICATION

This application claims the benefit under 35 U.S.C. §119 (e) and 37 C.F.R. §1.78 of U.S. Provisional Patent Application No. 61/558,529, filed on Nov. 11, 2011 and U.S. Provisional Patent Application No. 61/600,330, filed on Feb. 17, 2012. U.S. Provisional Patent Application Nos. 61/558,529 and 61/600,330 are incorporated by reference in their entireties.

This application is a continuation-in-part and claims the benefit under 35 U.S.C. §120 of U.S. patent application Ser. No. 13/430,601, filed on Mar. 26, 2012, which claims priority under 35 U.S.C. §119(e) to U.S. Provisional Patent Application No. 61/467,258, filed on Mar. 24, 2011 and U.S. Provisional Patent Application No. 61/532,980, filed on Sep. 9, 2011. U.S. patent application Ser. No. 13/430,601, U.S. Provisional Patent Application No. 61/467,258, and U.S. Provisional Patent Application No. 61/532,980 are incorporated by reference in their entireties.

BACKGROUND OF THE INVENTION

1. Field of the Invention

The present invention relates in general to the field of electronics, and more specifically to a lighting system and method with color mixing of electronic light sources in accordance with a correlation between phase-cut dimmer angles and a predetermined black body radiation function.

2. Description of the Related Art

Electronic light sources, such as light emitting diodes (LEDs), offer lower energy consumption and, in some instances, longer useful life relative to incandescent bulbs. In some instances, lamps with LEDs are designed to approximate the familiar color characteristics of incandescent bulbs. LEDs with different color spectra can be mixed within a lamp to obtain a particular color. The color spectrum (e.g. the dominant wavelength) and brightness (i.e. luminosity) of light emitted by an LED is a function of the junction temperature of the LED. Thus, as the junction temperature changes, the color of the LEDs can also change.

Correlated color temperature (CCT) and color spectra represent characteristics to classify the color of light emitted by a light source. The CCT of a light source is the color of an ideal black-body radiator that radiates light at a certain temperature that is perceived as the same color as the light source. The color spectrum is defined by the dominant wavelength of light emitted by the light source.

FIG. 1 depicts a lighting system 100 that includes a lamp 101 that includes a lamp 101, and the lamp 101 includes two sets of LEDs referred to as LEDs 102 and LEDs 104. LEDs 102 have a red-amber color spectrum, and LEDs 104 have a blue-white color spectrum. The overall color spectrum of the light emitted from lamp 101 is a mixture of the color spectra from LEDs 102 and LEDs 104 and varies with the intensity (i.e. brightness) of the respective LEDs 102 and LEDs 104. The intensity of LEDs 102 and LEDs 104 is a function of the respective currents $i_{LED_A}$ and $i_{LED_B}$ to LEDs 102 and LEDs 104.

The lighting system 100 receives an AC supply voltage $V_{SUPPLY}$ from voltage supply 106. The supply voltage $V_{SUPPLY}$ is, for example, a nominally 60 Hz/110 V line voltage in the United States of America or a nominally 50 Hz/220 V line voltage in Europe and the People's Republic of China. The full-bridge diode rectifier 105 rectifies the supply voltage $V_{SUPPLY}$ for input to switching power converter 110. Controller 112 controls the switching power converter 110 to generate a light source current $i_{LDC}$. Capacitors 120 and 122 each provide a standard filter across respective LEDs 102 and LEDs 104.

The current distributor 114 controls the current dividers 116 and 118 to respectively apportion the light source current $i_{LDC}$ as $i_{LED_A}$ to LEDs 102 and $i_{LED_B}$ to LEDs 104. Since the proportional intensity of LEDs 102 and LEDs 104 and, thus, the color spectrum of lamp 101, is a function of the currents $i_{LED_A}$ and $i_{LED_B}$, by apportioning the current distributed to LEDs 102 and 104, the current distributor 114 causes the lamp 101 to generate a proportion of red-amber color to white-blue color to emit light having a particular color spectra. The particular color spectra can be used to approximate a particular color generated by an incandescent bulb.

The color spectrum and brightness (i.e. luminosity) of an LED is a function of the junction temperature of the LED. Thus, as the junction temperature changes, the color of the LEDs can also change. The color spectrum of some LEDs varies with the junction temperatures of the LEDs more than others. For example, the brightness of blue-white LEDs varies less with temperature than that of red-amber LEDs. The lamp 101 includes a negative temperature coefficient (NTC) resistor 117 to allow the current distributor 114 to sense the ambient temperature in proximity to LEDS 102 and LEDs 104. The resistance of NTC resistor 117 is indirectly proportional to changes in the ambient temperature. Changes in the value of TDATA, which represents the temperature value from the NTC resistor 117, associated with changes in the resistance of the NTC resistor 117 represent changes in the ambient temperature. Thus, by determining the value of TDATA, the current distributor 114 senses changes in the ambient temperature in proximity to LEDs 102 and LEDs 104.

The spectrum of red-amber LEDs 102 is more sensitive to junction temperature changes than the blue-white LEDs 104. As the ambient temperature in proximity to LEDs 102 and LEDs 104 changes, the junction temperatures also change. Sensing the ambient temperature in proximity to LEDs 102 and LEDs 104 represents an indirect mechanism for sensing changes in the junction temperatures of LEDs 102 and LEDs 104. Thus, sensing the ambient temperature approximates sensing the respective color spectrum of LEDs 102 and LEDs 104. Accordingly, as the ambient temperature changes, the current distributor 114 adjusts the currents $i_{LED_A}$ and $i_{LED_B}$ to maintain an approximately constant color spectrum of lamp 101.

Thus, indirectly sensing the junction temperatures of the LEDs 102 and LEDs 104 allow the lighting system 100 to maintain an approximately constant color spectrum.

SUMMARY OF THE INVENTION

In one embodiment of the present invention, an apparatus includes a controller. The controller is configured to receive a phase-cut dimming level signal. The controller is further configured to control a color of mixed light emitted from at least two light emitting diode ("LED") emitters by responding to phase-cut angles of the dimming signal and correlating the phase-cut angles with a predetermined black body radiation function to dynamically adjust a color spectra of the mixed light in response to changes in phase cut angles of the phase-cut dimming level signal. During operation the LED emitters, the LED emitters emit light having at least three dominant wavelengths representing at least three different colors.

In another embodiment of the present invention, a method includes receiving a phase-cut dimming level signal. The method also includes controlling a color of mixed light emitted from at least two light emitting diode ("LED") emitters by responding to phase-cut angles of the dimming signal and correlating the phase-cut angles with a predetermined black body radiation function to dynamically adjust a color spectra of the mixed light in response to changes in phase cut angles of the phase-cut dimming level signal. During operation the LED emitters, the LED emitters emit light having at least three dominant wavelengths representing at least three different colors.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
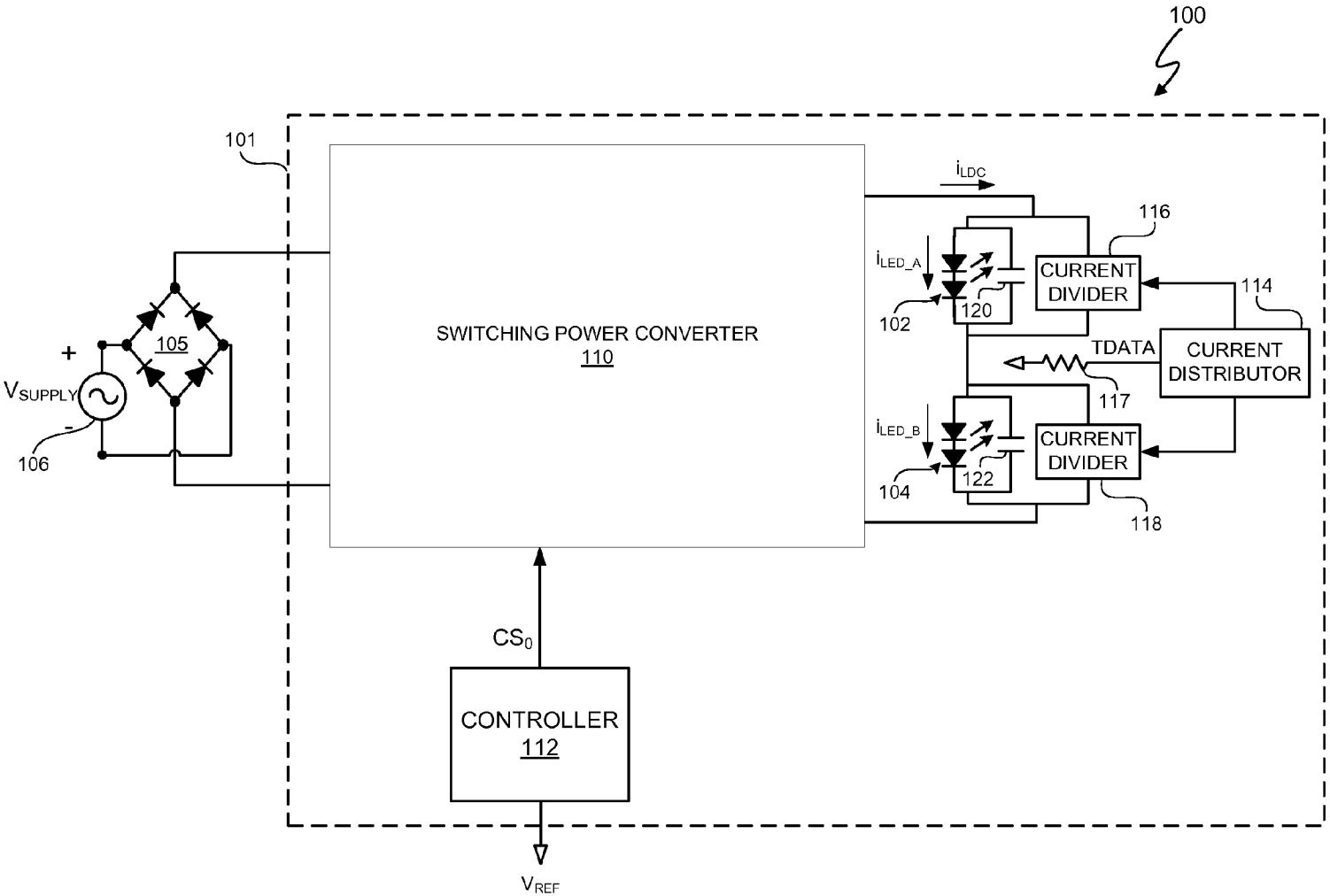
FIG. 1 (PRIOR ART)
FIG. 1 (labeled prior art) depicts a lighting system that includes two sets of LEDs and compensates for junction temperature changes to maintain a constant color.

A lighting system includes methods and systems to mix colors of light emitted from at least two LED emitters. In at least one embodiment, the lighting system includes a controller that responds to phase-cut angles of the dimming signal and correlates the phase-cut angles with a predetermined black body radiation function to dynamically adjust a color spectra of the mixed light in response to changes in phase cut angles of the phase-cut dimming level signal. In at least one embodiment, the controller utilizes the predetermined black body radiation function to dynamically adjust the color spectra of the mixed, emitted light in response to changes in phase cut angles of a phase-cut dimming level signal. In at least one embodiment, the predetermined black body radiation function specifies correlated color temperatures (CCTs) that model the CCTs of an actual non-LED based lamp, such as an incandescent lamp. The lighting system includes a controller that is configured to apply the predetermined black body radiation function to correlate the dimming level signal with at least first and second light emitting diode ("LED") drive current levels. In at least one embodiment, the LED emitters collectively emit light at three or more dominant wavelengths. The resulting color gamut achievable by the lighting system incorporates all of part of the CCTs of the predetermined black body radiation function.

The relative brightness of the LED emitters determines the dominant wavelength of light emitted by the mixed light of the LED emitters. The controller correlates dimming levels with the CCTs of the predetermined black body radiation function and utilizes the correlation to control LED drive currents. LED drive currents control the brightness of each LED emitters and, thus, the dominant wavelength of the lighting system. The controller responds to changes in the dimming level by adjusting the LED drive currents to maintain a correlation between the dimming level, the CCTs of the predetermined black body radiation function, and, thus, the dominant wavelength of the light emitted by the mixed light of the LED emitters.

The dominant wavelengths of light emitted by the LED emitters define a color gamut of light emitted by the lighting system. In at least one embodiment, a controller of the lighting system correlates a particular dimming level with a particular CCT defined by the predetermined black body radiation function. In at least one embodiment, the predetermined black body radiation function defines a curve of CCTs matching a color spectrum of an incandescent bulb from approximately no dimming to approximately fully dimmed.

In at least one embodiment, to adjust the color spectra of the mixed, emitted light, the controller varies drive currents to the LED emitters so that the color spectra of the mixed, emitted light from the LED emitters approximately tracks the color spectrum defined by the predetermined black body radiation function in response to changes in the phase cut angles of the phase-cut dimming level signal. In at least one embodiment, the controller directly or indirectly relates the current, the dimming level in the lighting system, and the predetermined black body radiation function to control the adjustable color spectra of the lighting system. In at least one embodiment, the controller is programmable to specify the particular relationships between the current, the dimming level, and the predetermined black body radiation function. In at least one embodiment, the predetermined black body radiation function is also programmable, and programming data and the black body radiation function are stored in a non-volatile memory. In at least one embodiment, the values of the drive currents (or a parameter representing the drive current) are pre-calculated based on the color spectra control function, dimming levels, and the predetermined black body radiation function.

The junction temperatures of one or more of the LEDs in the LED emitters can also be factored into the color spectra control function to maintain a particular color spectra. In at least one embodiment, the pre-calculated values of the drive currents can be stored in a memory in a desired format, such as in a look-up-table. In at least one embodiment, some of the drive current values are pre-calculated and stored in a memory, and the controller determines other drive current values using the color spectra control function.

In at least one embodiment, the color spectra or spectrum of light emitted by an LED emitter is a function of the color of light emitted by the LED emitter and any lumiphors incorporated into the LED emitter. A lumiphor is a structure that contains any luminescent material that generally converts exciting radiation of one wavelength to responsive radiation, such as visible light, of another wavelength. For example, many lumiphors can receive a photon of a wavelength representing a certain color of light and emit a photon of a wavelength representing a different color of light. Luminescent materials include phosphors, scintillators, and glow tapes and inks. In at least one embodiment, the particular lumiphors and LEDs define the color gamut for the lighting system.

Figure 2:
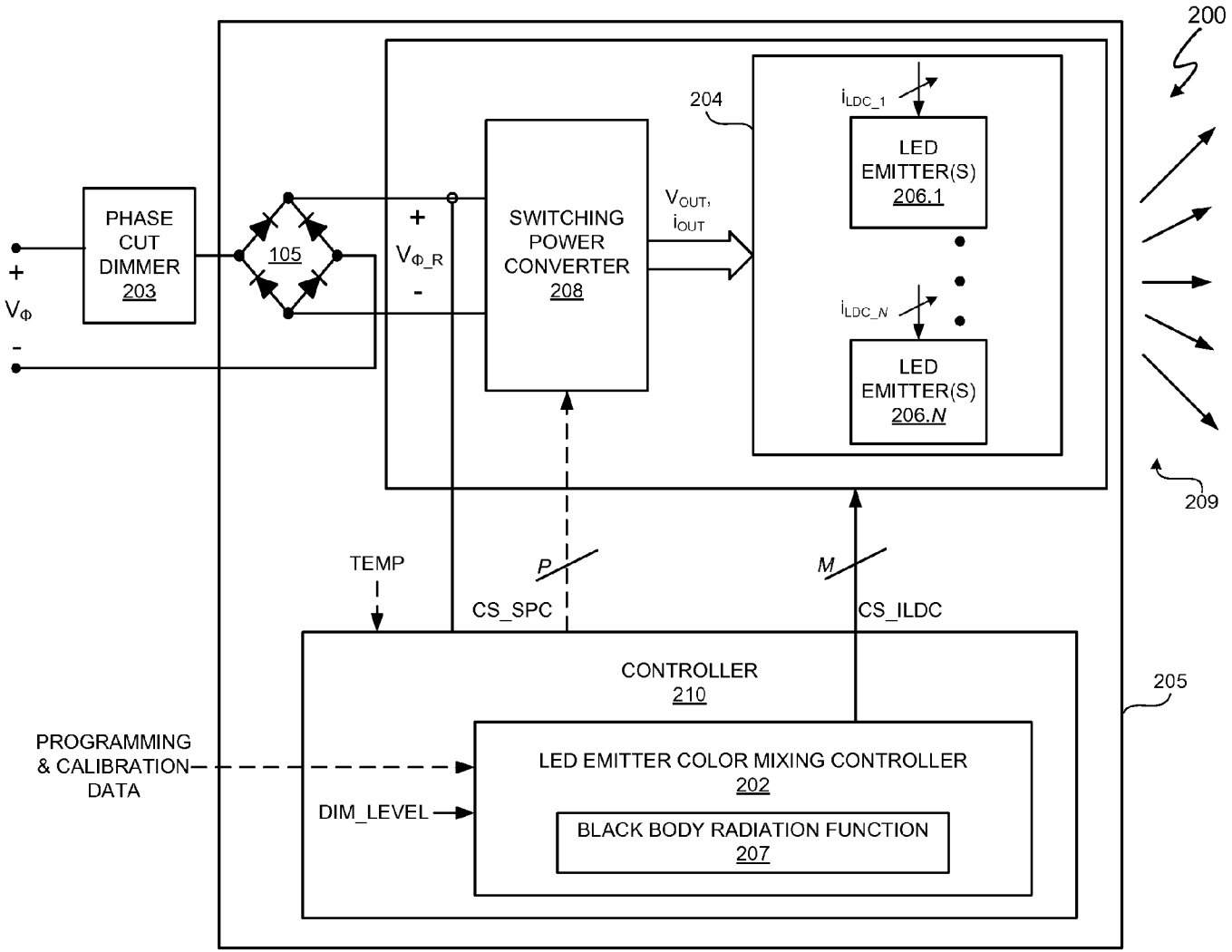
FIG. 2 depicts a lighting system that mixes colors from at least two LEDs in accordance with a correlation between phase-cut dimmer angles and a predetermined black body radiation function.

FIG. 2 depicts a lighting system 200 that includes a LED emitter color mixing controller 202 to control the color and intensity of light 209 emitted by the LED emitter group 204 of lamp 205 by controlling LED drive currents $i_{LDC_1}$-$i_{LDC_N}$ to respective LED emitters 206.1-206.N using a black body radiation function and a dimming level indicated by the phase-cut dimming level signal DIM_LEVEL. "N" is an integer index number greater than or equal to two (2). In at least one embodiment, the LED emitter color mixing controller 202 controls the respective LED drive currents $i_{LDC_1}$-$i_{LDC_3}$. Controlling the LED drive currents $i_{LDC_1}$-$i_{LDC_N}$ controls the brightness of respective LED emitters 206.1-206.N. As subsequently described in more detail, controlling the brightness of the LED emitters 206.1-206.N controls the color spectra of mixed light emitted by the LED emitters 206.1-206.N. In at least one embodiment, the controller 210 samples the phase-cut, rectified input voltage $V_{\phi_R}$. Each of the N LED emitters 206.1-206.N includes one or more electronic light sources, such as one or more LEDs.

The lighting system 200 receives a supply voltage $V_{\phi}$. The supply voltage $V_{\phi}$ is, for example, a line voltage such as $V_{SUPPLY}$ (FIG. 1). The phase cut dimmer 203 phase-cuts the supply voltage $V_{\phi}$, as subsequently described in more detail, to generate the phase cut voltage version of supply voltage $V_{\phi}$. The phase cut dimmer 203 can be any type of phase cut dimmer, such as a triac-based dimmer or a solid state dimmer, and can be a leading edge or a trailing edge dimmer. Full-bridge diode rectifier 105 rectifies the phase-cut supply voltage $V_{\phi}$ to generate a phase, cut rectified supply voltage $V_{\phi_R}$. Switching power converter 208 converts the rectified, phase-cut supply voltage $V_{\phi_R}$ into one or more, approximately constant (DC) output voltages $V_{OUT}$ and one or more output currents $i_{OUT}$. The particular configuration of the LED emitters 206.1-206.N is a matter of design choice. In one embodiment, the LED emitters 206.1-206.N are connected in series, and the switching power converter 208 supplies one output voltage $V_{OUT}$ and one output current $i_{OUT}$ to all the LED emitters 206.1-206.N. In at least one embodiment, the LED emitters 206.1-206.N are connected in parallel, and the switching power converter 208 generates a separate output voltage and separate output current $i_{OUT}$ for each of LED emitters 206.1-206.N. The particular type of switching power converter 208 is a matter of design choice. For example, the switching power converter 208 can be a boost, buck, boost-buck, flyback, Cúk type switching power converter or a combination of any of the foregoing types of switching power converters.

In at least one embodiment, the LED emitter color mixing controller 202 is part of a larger controller 210. The controller 210 generates P switching power converter control signals CS_SPC to control generation of the output voltage $V_{OUT}$ and output current $i_{OUT}$. "P" is an integer greater than or equal to 1. U.S. Patent Application Publication 2012/0025733 entitled "Dimming Multiple Lighting Devices by Alternating Energy Transfer From a Magnetic Storage Element", inventor John L. Melanson, assignee Cirrus Logic, Inc. (referred to herein as "Melanson I") describes exemplary methods and systems for generating the control signals CS_SPC to control a boost-type switching power converter with a fly-back converter. Melanson I is hereby incorporated by reference in its entirety. In at least one embodiment, controller 210 controls the switching power converter 208 as described in, for example, U.S. patent application Ser. No. 11/967,269, entitled "Power Control System Using a Nonlinear Delta-Sigma Modulator With Nonlinear Power Conversion Process Modeling", filed on Dec. 31, 2007, inventor John L. Melanson, U.S. patent application Ser. No. 11/967,275, entitled "Programmable Power Control System", filed on Dec. 31, 2007, and inventor John L. Melanson, U.S. patent application Ser. No. 12/495,457, entitled "Cascode Configured Switching Using at Least One Low Breakdown Voltage Internal, Integrated Circuit Switch to Control At Least One High Breakdown Voltage External Switch", filed on Jun. 30, 2009, and inventor John L. Melanson, or U.S. patent application Ser. No. 12,174,404, entitled "Constant Current Controller With Selectable Gain", filing date Jun. 30, 2011, and inventors John L. Melanson, Rahul Singh, and Siddharth Maru, which are all incorporated by reference in their entireties.

The implementation of controller 210 including LED emitter color mixing controller 202 is a matter of design choice. For example, controller 210 can be implemented as an integrated circuit, discrete components, or as a combination of an integrated circuit and discrete components. Additionally, in at least one embodiment, the controller 210 utilizes software to perform some functions.

The LED emitter color mixing controller 202 determines LED drive current levels to generate LED drive currents for LED emitters 206.1-206.N. To determine the LED drive current levels, the LED emitter color mixing controller 202 applies the predetermined black body radiation function 207 to correlate the dimming level signal DIM_LEVEL with LED drive current levels. In at least one embodiment, the predetermined black body radiation function 207 specifies CCTs for a particular dimming level value of the DIM_LEVEL signal, and the controller 202 correlates drive current levels to the CCTs of the predetermined black body radiation function 207 and the dimming level values. Thus, in at least one embodiment and as subsequently described in more detail, for each particular dimming level value of the DIM_LEVEL signal, the LED emitter color mixing controller 202 determines drive current levels to generate the LED drive currents $i_{LDC_1}$ to $i_{LDC_N}$ so that LED emitters 206.1-206.N emit light at respective brightness levels that when mixed has a CCT approximating a CCT of the predetermined black body radiation function 207. The particular predetermined black body radiation function 207 is a matter of design choice. In at least one embodiment, the predetermined black body radiation function defines a curve of CCTs matching a color spectrum of an incandescent bulb from approximately no dimming to approximately fully dimmed. The predetermined black body radiation function can also include several predetermined black body radiation functions that emulate various types of light sources or provide any desired color effects. Any curve or other function can be approximated using, for example, any well-known curve fitting function tool to define the curve or function as a polynomial equation. Values of the curve can also be stored in a look-up-table.

In at least one embodiment, the LED emitter color mixing controller 202 generates M control signal(s) CS_ILDC to control the currents $i_{LDC_1}$-$i_{LDC_N}$. M is a positive integer less than or equal to N (N is the number of LED emitters 206.1 through 206.N.) In at least one embodiment, the LED emitter color mixing controller 202 also responds to the dimming level represented by the signal DIM_LEVEL by adjusting the brightness of light from LED emitter group 204. The LED emitter color mixing controller 202 reduces the brightness of light emitted by the LED emitters 206.1-206.N by reducing one or more of light source currents $i_{LDC_1}$-$i_{LDC_N}$. The LED emitter color mixing controller 202 increases the brightness of light emitted by the LED emitters 206.1-206.N by increasing one or more of LED drive currents $i_{LDC_1}$-$i_{LDC_N}$. The DIM_LEVEL signal can be any signal representing a dimming level of the lighting system 200. An exemplary mechanism for generating the control signal(s) CS_ILDC is described in Melanson I. Exemplary generation of the control signal(s) CS_ILDC in accordance with the value of the DIM_LEVEL signal and the black body radiation function 207 is subsequently described.

In at least one embodiment, the controller 210 receives temperature data TEMP and is responsive to changes in the ambient temperature and, thus, changes to the junction temperature of the LED emitters 206.1-206.N. Adjusting the LED drive currents $i_{LDC_1}$-$i_{LDC_N}$ is described in "U.S. patent application Ser. No. 13/430,601, entitled "Color Coordination of Electronic Light Sources With Dimming and Temperature Responsiveness", filed on Mar. 26, 2012, inventors Alfredo R. Linz, Michael A. Kost, and Sahil Singh (referred to herein as the "Linz Patent").

Figure 3:
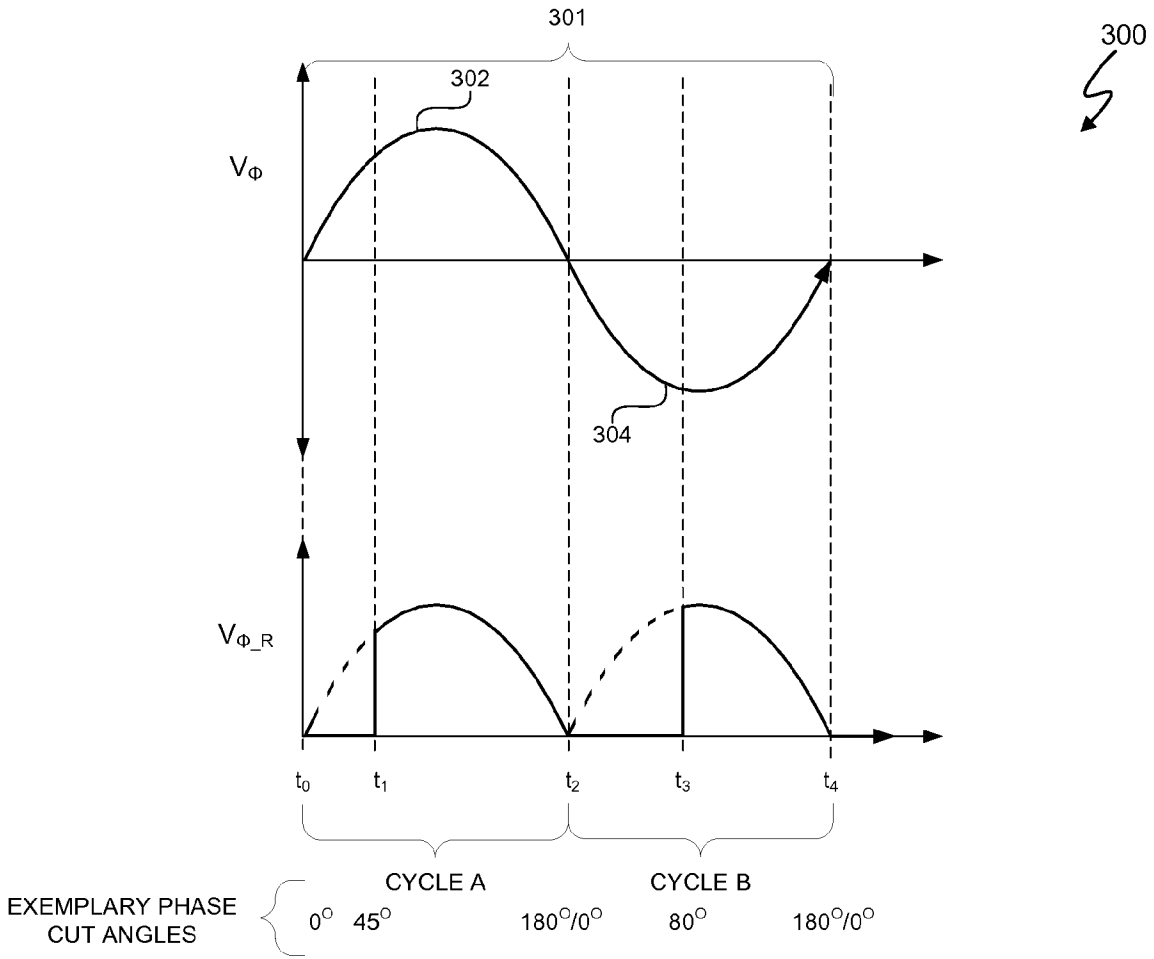
FIG. 3 depicts exemplary phase cut voltages.

FIG. 3 depicts exemplary voltage waveforms 300 of the supply voltage $V_\phi$ and phase cut, rectified input voltage $V_{\phi_R}$. Referring to FIGS. 2 and 3, if dimmer 203 is a leading edge, phase cut dimmer, the dimmer 203 phase cuts a leading edge of the supply voltage $V_\phi$ at a particular phase angle. One cycle 301 of the supply voltage $V_\phi$ is depicted in FIG. 3. The phase cut, rectified input voltage $V_{\phi_R}$ depicts two cycles, cycle A and cycle B, which are derived from the cycle 301 of the supply voltage $V_\phi$. Cycle A is a phase cut version of the first half cycle 302 of the supply voltage $V_\phi$, and cycle B is a rectified, phase cut version of the second half cycle 304 of the supply voltage $V_\phi$. Cycle A occurs from time $t_0$ until the zero crossing of the supply voltage $V_\phi$ at time $t_2$. Cycle B occurs from time $t_2$ until the next zero crossing at time $t_4$ of the supply voltage $V_\phi$. Between times $t_0$ and $t_1$ and between times $t_2$ and $t_3$, the dimmer 203 does not conduct current and, thus, phase cuts the supply voltage $V_\phi$ until time $t_1$ and, after time $t_2$, until time $t_3$. At times $t_1$ and $t_3$, the dimmer 203 conducts so that the phase cut, rectified input voltage $V_{\phi_R}$ equals a rectified version of the supply voltage $V_\phi$.

The phase cuts at times $t_1$ and $t_3$ occur at respective phase angles of the phase cut, rectified voltage $V_{\phi_R}$. In at least one embodiment, the phase angles or phase cut times represent specific dimming levels that are used by LED emitter color mixing controller 202 to determine the color spectra of the light 209 emitted from lamp 205.

Figure 4:
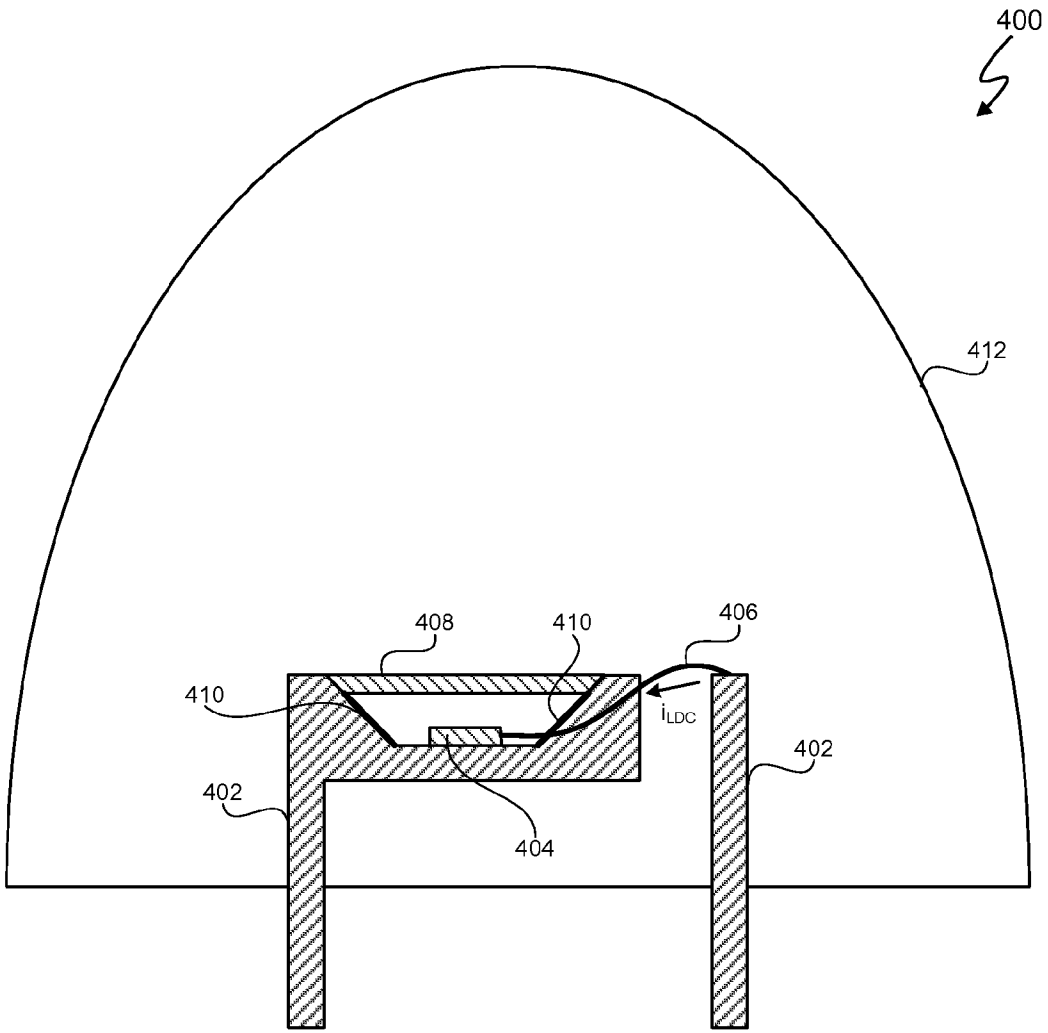
FIG. 4 depicts an exemplary LED emitter.

FIG. 4 depicts a cross-sectional view of an exemplary LED emitter 400. The LED emitter 400 represents an exemplary embodiment LED emitters 206.1-206.N. The LED emitter 400 includes a lead frame 402 that supports a chip 404. When the wire 406, connected to the chip 404, conducts the LED drive current $i_{LDC}$, the chip 404 emits photons. The photons directly strike the lumiphor 408 or are reflected to the lumiphor 408 by reflective surface 410. An encapsulate region 412 forms an enclosure for the LED emitter 400. Luminscent material can also be dispersed on the surface of the encapsulate 412 and/or embedded in the encapsulate 412 so that the encapsulate 412 also becomes a lumiphor. In at least one embodiment, the LED emitter does not include the lumiphor 408 and/or does not include any significant amount of luminescent material. The particular size, density, disbursement pattern, luminescent material type, color spectra of light emitted from chip 404, etc. determine the dominant wavelength(s) of light emitted by the LED emitter 400. The particular luminescent material is a matter of design choice. Construction and design of an exemplary LED emitter 400 having one or more dominant wavelengths is, for example, described in U.S. Pat. No. 7,213,940.

Figure 5A:
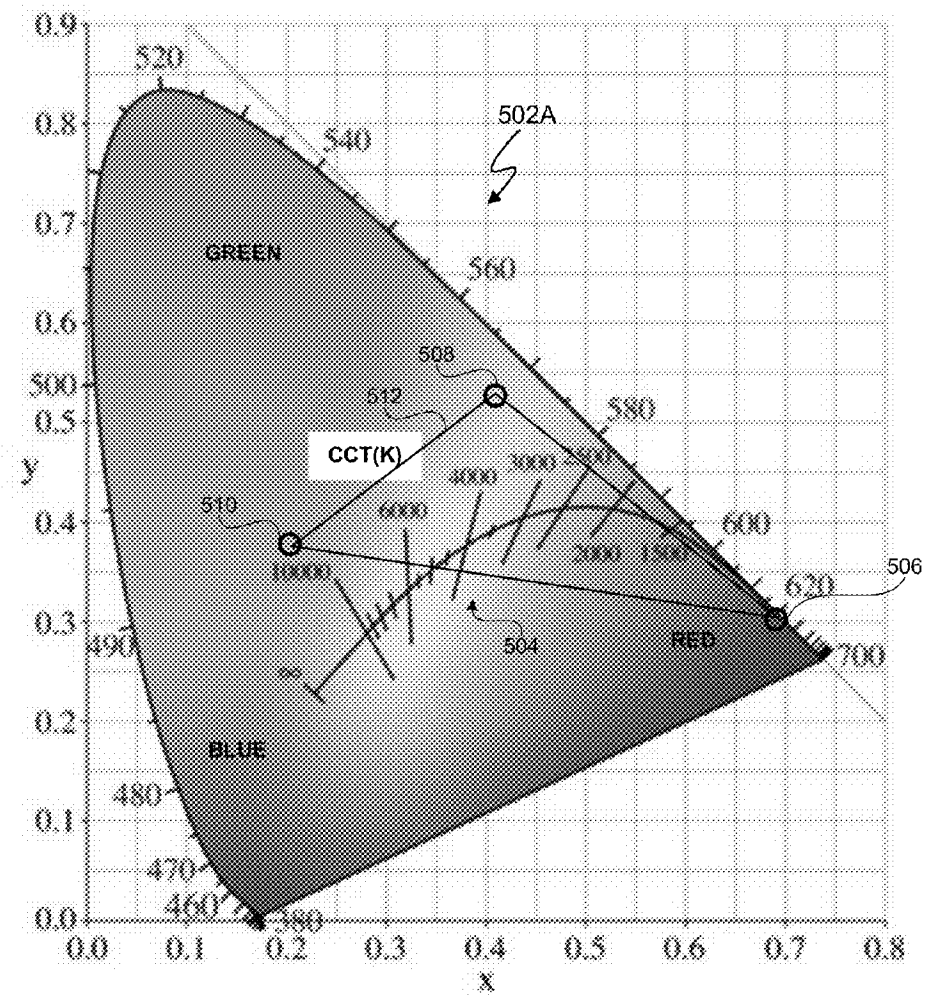
FIGS. 5A, 5B, and 5C depict International Commission on Illumination (CIE) diagrams with color gamuts derived from mixing at least 3 colors from at least two LED emitters.
Figure 5B:
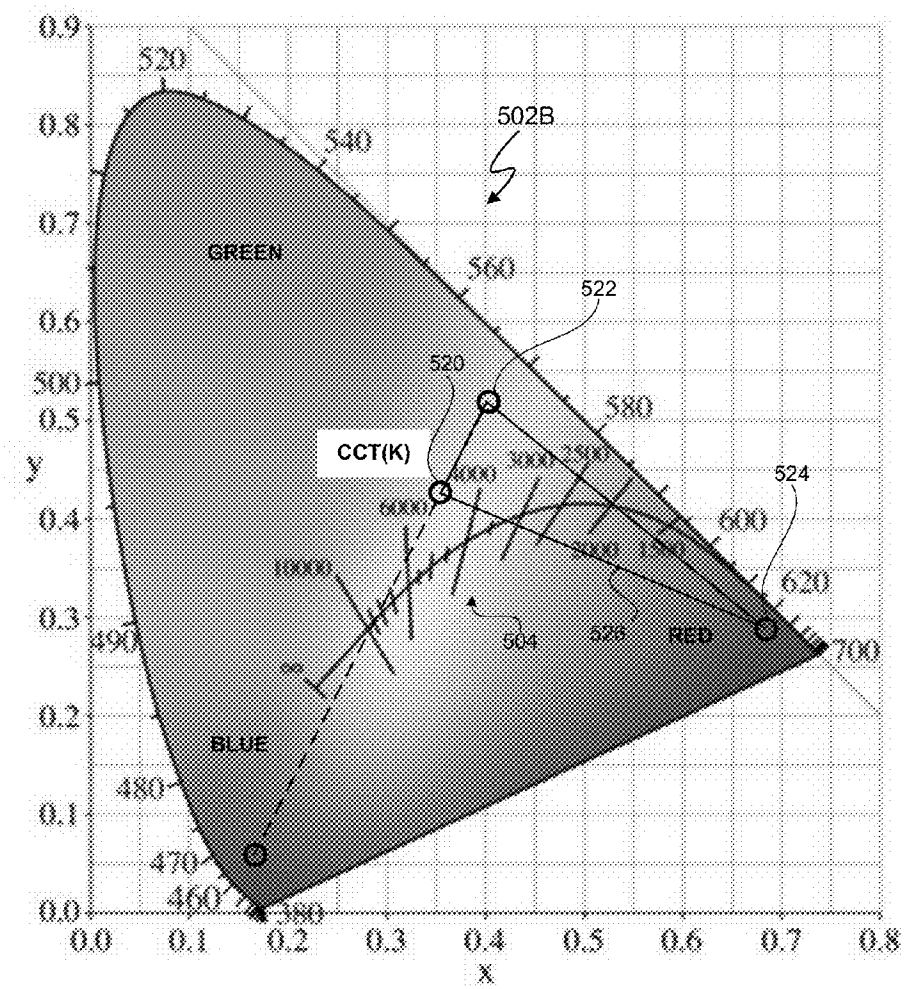
Figure 5C:
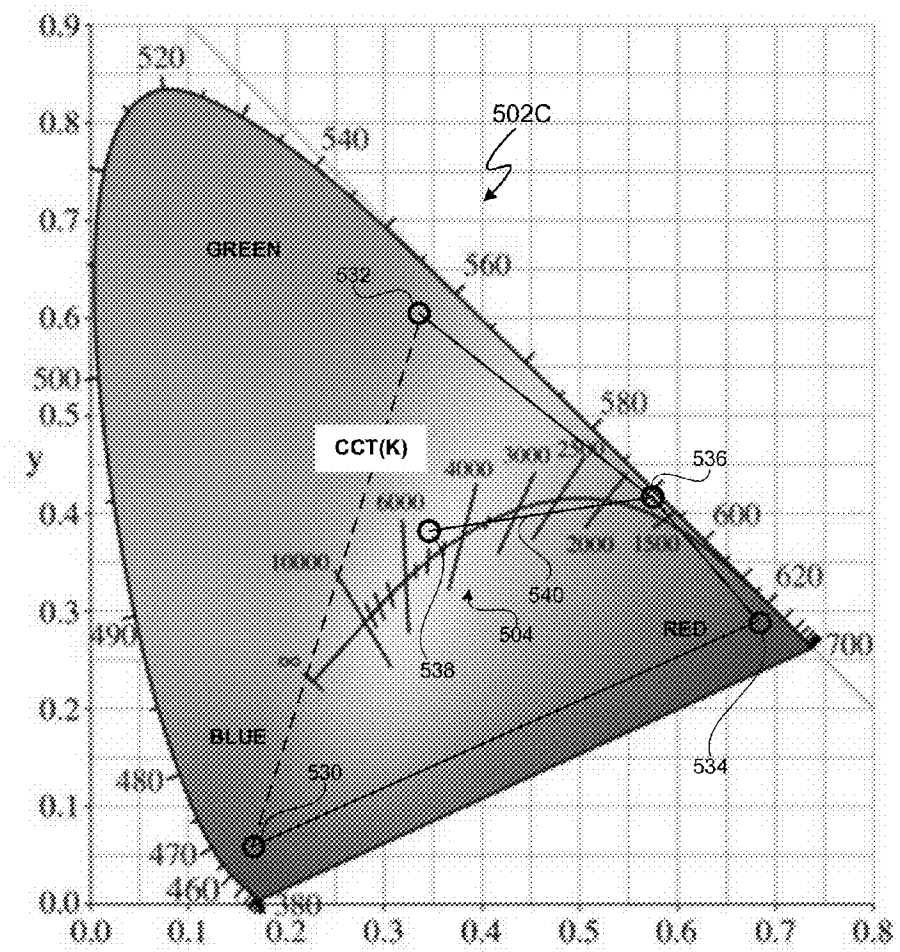

FIGS. 5A-5C depict International Commission on Illumination (CIE) diagrams with color gamuts derived from mixing at least 3 colors from at least two LED emitters 206.1-206.N. The CIE diagrams 502A, 502B, and 502C represent a color space created by CIE in 1931 to define the entire gamut of colors visible to the average human viewer. The x and y axes specify 2-dimensional reference coordinates. Numbers on the perimeter of the CIE diagrams 502A, 502B, and 502C represent wavelengths of light. Blue wavelengths are approximately 430 nm to 490 nm. Green wavelengths are about 490 nm to about 570 nm. Yellow is about 570 nm to about 590 nm, and red is any visible light greater than about 600 nm. The black body radiation curve 504 represents the CCTs of an exemplary incandescent bulb in Kelvin over a full dimming range. A CCT of approximately 5000K represents a dimming level of approximately 100% corresponding to a phase cut angle of approximately 0-5 degrees, and, in at least one embodiment, a CCT of approximately 1500K represents a dimming level of approximately 2-10% corresponding to a phase cut angle of approximately 4-20 degrees. In at least one embodiment, a CCT of approximately 1500K represents a phase cut angle of approximately 45°, as described with reference to FIG. 6.

Referring to FIGS. 2 and 5A, the LED emitter group 204 has three LED emitters 206.1-206.3. LED emitter 206.1 emits light with a red dominant wavelength 506. LED emitter 206.2 emits light with a yellow dominant wavelength 508, and LED emitter 206.3 emits light using a blue LED and a lumiphor that converts some blue light to a greenish dominant wavelength 510. The lines connecting dominant wavelengths 506-508 form a triangle that defines a color gamut 512. By adjusting the brightness of LED emitters 206.1-206.3, the lamp 205 can emit a light color 209 anywhere within the color gamut 512. By adjusting the respective LED drive currents $i_{LDC_1}$-$i_{LDC_3}$, the LED emitter color mixing controller 202 adjusts the brightness of LED emitters 206.1-206.3.

The black body radiation curve 504 of an incandescent bulb lies within the color gamut 512 from 1500K-5000K. Thus, by appropriately adjusting the respective LED drive currents $i_{LDC_1}$-$i_{LDC_3}$, the LED emitter color mixing controller 202 can cause the light 209 to have a color spectra anywhere along the black body radiation curve 504 of an incandescent bulb from 1500K-5000K. Determining the values of the respective LED drive currents $i_{LDC_1}$-$i_{LDC_3}$ that correspond to CCTs on along the black body radiation curve 504 is a matter of design choice and can be done empirically or by calculation using response characteristics of the LED emitters 206.1-206.3. In at least one embodiment, the efficacy of each of LED emitters 206.1-206.N is calibrated by providing the programming & calibration data to the LED emitter color mixing controller 202 as, for example, described in U.S. Patent Application No. 2010/0277072, inventors William Draper, Robert Grisamore, and John Melanson, and assignee Cirrus Logic, Inc., which is incorporated by reference in its entirety. "Efficacy" is defined herein as the light output of an LED emitter 206 divided by the total electrical power input to the light source, expressed in lumens per watt (lm/W). A phase cut angle corresponds to a particular dimming value of the DIM_LEVEL signal, and the dimming values correlate with respective CCTs along the black body radiation curve 504. The particular correspondence is a matter of design choice with an example correlation shown in FIG. 6, which is discussed below. By applying the CCTs of the black body radiation curve 504 to correlate the dimming levels from the phase cut dimmer 203 to LED drive current levels for the respective LED drive currents $i_{LDC_1}$-$i_{LDC_3}$, the LED emitter color mixing controller 202 controls the respective LED drive currents $i_{LDC_1}$-$i_{LDC_3}$ so that the light 209 has a dominant wavelength that at least approximates the CCT of the incandescent bulb when dimmed.

The manner of applying the CCTs of the black body radiation curve 504 to correlate the dimming levels from the phase cut dimmer 203 to LED drive current levels for the respective LED drive currents $i_{LDC_1}$-$i_{LDC_3}$, is a matter of design choice. In at least one embodiment, the dominant wavelength of each of LED emitters 206.1 through 206.N is known or stored as a value in the LED emitter color mixing controller 202 or is received as data from a color sensor (not shown). Any method including well-known methods can be used to determine a function that specifies the spectra of the mixed light from the LED emitters 206.1 through 206.N as a function of the drive current to LED emitters 206.1 through 206.N. The particular function depends on the color spectra of each of the LED emitters 206.1 through 206.N and the physical parameters of brightness-to-LED drive current of the LED emitters 206.1 through 206.N. Thus, by using the black body radiation function, a function correlating dimming levels to the black body radiation function, and the function correlating the LED drive currents to a color spectra of the mixed light from the LED emitters 206.1 through 206.N, the LED emitter color mixing controller 202 can apply the black body radiation function to correlate the dimming level signal with at least first and second light emitting diode ("LED") drive current levels to control the drive currents to the LED emitters 206.1 through 206.N.

As the phase cut dimmer 203 changes the phase cut angle of the rectified voltage $V_{\phi_R}$, the LED emitter color mixing controller 202 responds to changes in the corresponding dimming level signal DIM_LEVEL by applying predetermined black body radiation function to re-correlate the dimming level signal DIM_LEVEL with revised current level values of LED drive currents $i_{LDC_1}$-$i_{LDC_3}$. The black body radiation curve 504 represents one example of a predetermined black body radiation function 207.

Additionally, the particular color spectra or spectrum of each of LED emitters 206.1-206.N is a matter of design choice. FIG. 5B utilizes two LED emitters 206.1 and 206.2. The LED emitter 206.1 includes a blue LED and lumiphors that shift the color of the blue LED to the dominant wavelengths 520 and 522. The LED emitter 206.2 includes a red LED with a dominant wavelength 524, which established a color gamut within triangle 526. As previously described, by applying the CCTs of the black body radiation curve 504 to correlate the dimming levels from the phase cut dimmer 203 to LED drive current levels for the respective LED drive currents $i_{LDC_1}$-$i_{LDC_3}$, the LED emitter color mixing controller 202 controls the respective LED drive currents $i_{LDC_1}$-$i_{LDC_3}$ so that the light 209 has a dominant wavelength that at least approximates the CCT of the incandescent bulb when dimmed.

FIG. 5C utilizes three LED emitters 206.1-206.3. The LED emitter 206.1 includes a blue LED with dominant wavelength 530 and lumiphors that shift the color of the blue LED to the green dominant wavelength 532. The LED emitter 206.1 also includes a red LED, which has a dominant wavelength 534. Thus, the LED emitter color mixing controller 202 can generate an LED drive current $i_{LDC_1}$ to cause the LED emitter 206.1 to emit light at a dominant wavelength 538. The LED emitter 206.2 includes a yellow/amber LED with a dominant wavelength 524, which established a color gamut along line 540, which closely approximates the black body radiation curve 504 between 5000K and 1800K. As previously described, by applying the CCTs of the black body radiation curve 504 to correlate the dimming levels from the phase cut dimmer 203 to LED drive current levels for the respective LED drive currents $i_{LDC_1}$-$i_{LDC_2}$, the LED emitter color mixing controller 202 controls the respective LED drive currents $i_{LDC_1}$-$i_{LDC_2}$ so that the light 209 has a dominant wavelength that at least approximates the CCT of the incandescent bulb when dimmed.

The number of LEDs within each LED emitter 206, and the number of LED emitters 206.1-206.N is a matter of design choice. The colors and color shifting using, for example, lumiphors, of the LED emitters 206.1-206.N is also a matter of design choice. In at least one embodiment, the choice of the number of LEDs within each LED emitter 206, the number of LED emitters 206.1-206.N, and the colors of light depend on a number of variables, such as the level of brightness desired, the particular black body radiation function to be applied by the LED emitter color mixing controller 202, the degree of accuracy desired between the actual CCT of the light 209 and the CCT of the particular, applied black body radiation function, and the cost of the LED emitters 206.1-206.N and the LED emitter color mixing controller 202.

Figure 6:
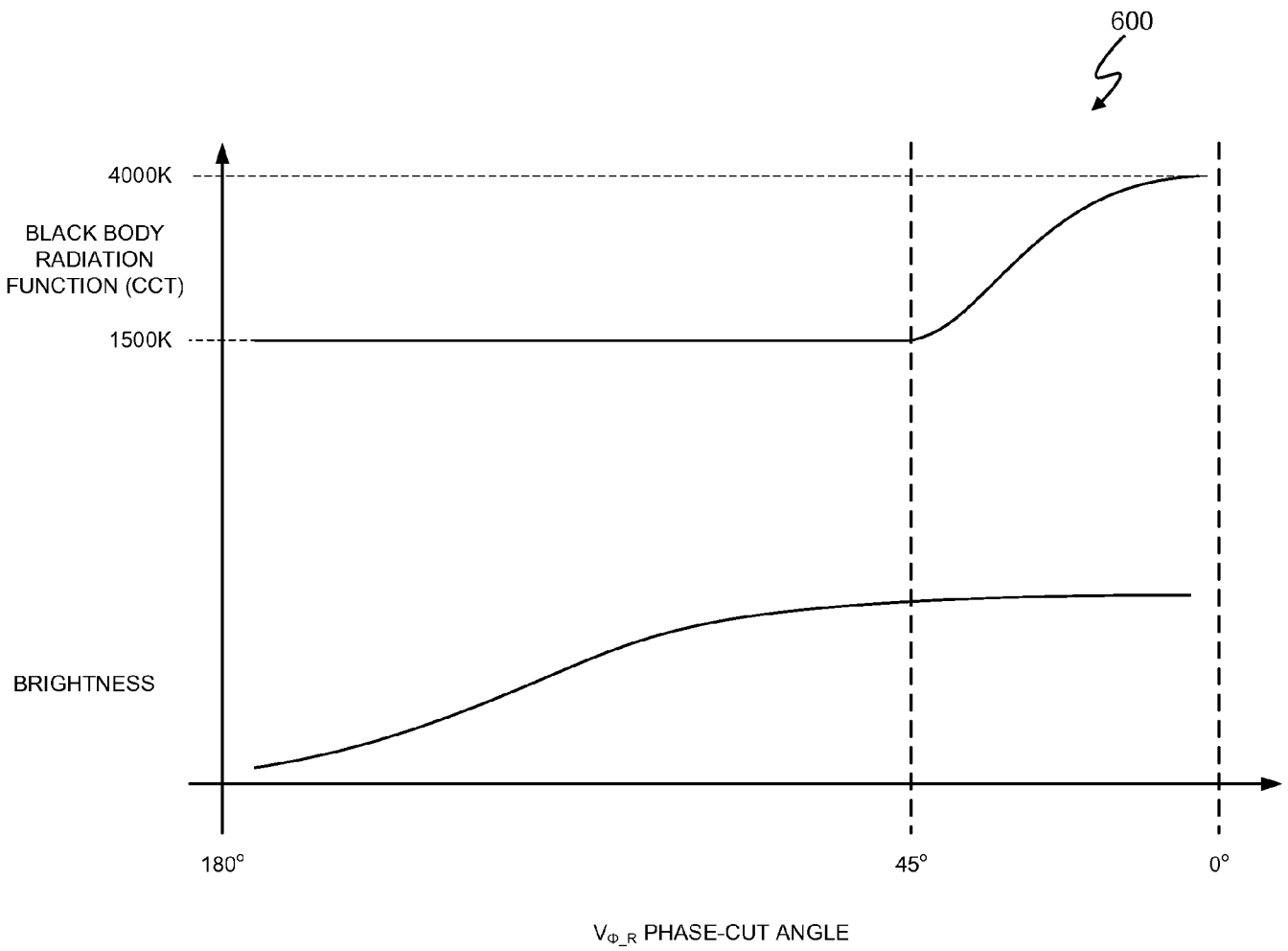
FIG. 6 depicts an exemplary control correlated color temperature-brightness correlation profile.

Referring to FIGS. 2 and 6, FIG. 6 depicts an exemplary control CCT-brightness correlation profile 600 for use by LED emitter color mixing controller 202 to control the color and intensity of light 209 based on the dimmer level represented by the DIM_LEVEL signal. At low phase angles, the LED emitter color mixing controller 202 generates the LED drive currents $i_{LDC_1}$-$i_{LDC_N}$ so that the lamp 205 generates light 209 with a CCT of 4500K at a maximum brightness. As the phase angle cut increases, the LED emitter color mixing controller 202 generates the LED drive currents $i_{LDC_1}$-$i_{LDC_N}$ so that the lamp 205 generates light 209 with a CCT decreasing from 4500K to 1500K while maintaining maximum brightness. As the phase angle cut continues to increase, the LED emitter color mixing controller 202 generates the LED drive currents $i_{LDC_1}$-$i_N$ so that the CCT remains at 1500K while the brightness is decreased. Thus, the control CCT-brightness correlation profile 600 can be used to allow the lighting system 200 to replace an incandescent bulb while providing a bright reading mode for all levels of CCTs. The particular control CCT-brightness correlation profile is a matter of design choice.

Figure 7:
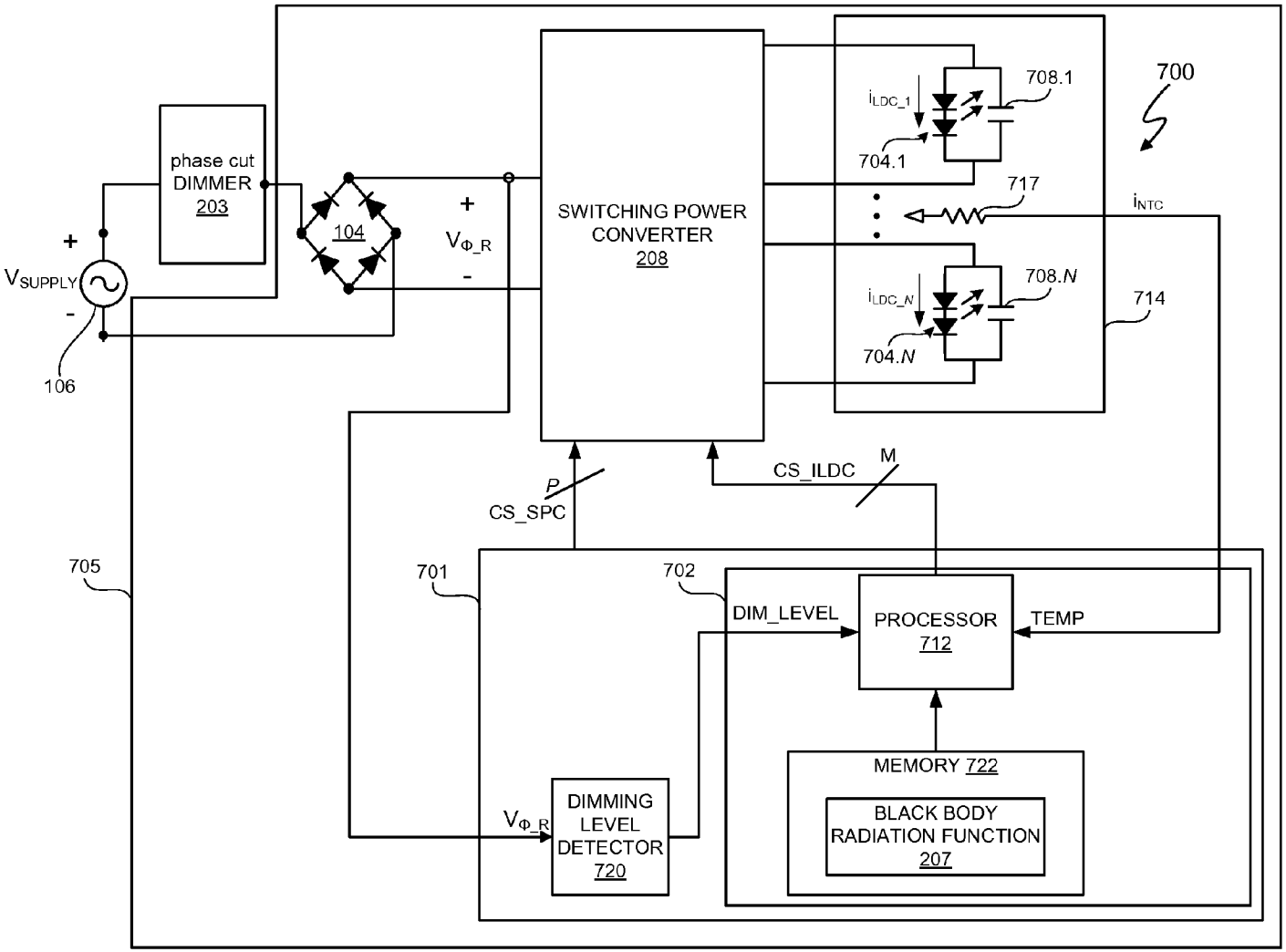
FIG. 7 depicts an embodiment of the lighting system of FIG. 2.

FIG. 7 depicts lighting system 700, which represents one embodiment of lighting system 200. Controller 701 represents one embodiment of controller 210, and LED emitter color mixing controller 702 represents one embodiment of LED emitter color mixing controller 202. Lamp 705 represents one embodiment of lamp 205 (FIG. 2). The LED emitter color mixing controller 702 includes a processor 712 to generate the M number of LED control signals CS_ILDC to control the LED drive currents $i_{LDC_1}$-$i_{LDC_N}$. Capacitors 708.1-708.N each provides a standard filter across respective LED emitters 704.1 and 704.N. The manner of determining the ambient temperature indicated by the NTC resistor 717 is a matter of design choice and is, for example, described in the Linz Patent. The dimming level detector 720 detects the phase cut angle or phase cut time from the phase cut, rectified input voltage $V_{\phi_R}$ and provides the dimming level signal DIM_LEVEL to processor 712. Exemplary dimming level detectors are described in U.S. patent application Ser. No. 13/290,032, entitled "Switching Power Converter Input Voltage Approximate Zero Crossing Determination", filed on Nov. 4, 2011, inventors Eric J. King, John L. Melanson, which is incorporated by reference in its entirety.

The processor 712 utilizes the temperature of the LED group 714, the dimming level of the lighting system 700 as represented by the respective TEMP and DIM_LEVEL signals, and the black body radiation function 207 stored in memory 722 to generate the control signals CS_ILDC to control the LED drive currents $i_{LDC_1}$-$i_{LDC_N}$. In at least one embodiment, the predetermined black body radiation function is represented by a map that correlates dimming level signal DIM_LEVEL values to the levels for the LED drive currents $i_{LDC_1}$-$i_{LDC_N}$. The memory 722 stores the map, and the processor 712 retrieves data from the map in the memory 722 that corresponds to the dimming level signal DIM_LEVEL values to generate light from LED emitters 704.1-704.N having CCTs that tracks the dimming signal level and the predetermined black body radiation function 207. In at least one embodiment, the predetermined black body radiation function 207 is represented by an algorithm stored in the memory 722. To correlate the dimming level signal DIM_LEVEL values with the LED drive currents $i_{LDC_1}$-$i_{LDC_N}$, the processor 712 calculates the LED drive currents $i_{LDC_1}$-$i_{LDC_N}$ levels to cause the LED emitters 704.1-704.N to generate light having CCTs that track the dimming signal level and the predetermined black body radiation function 207.

Figure 8:
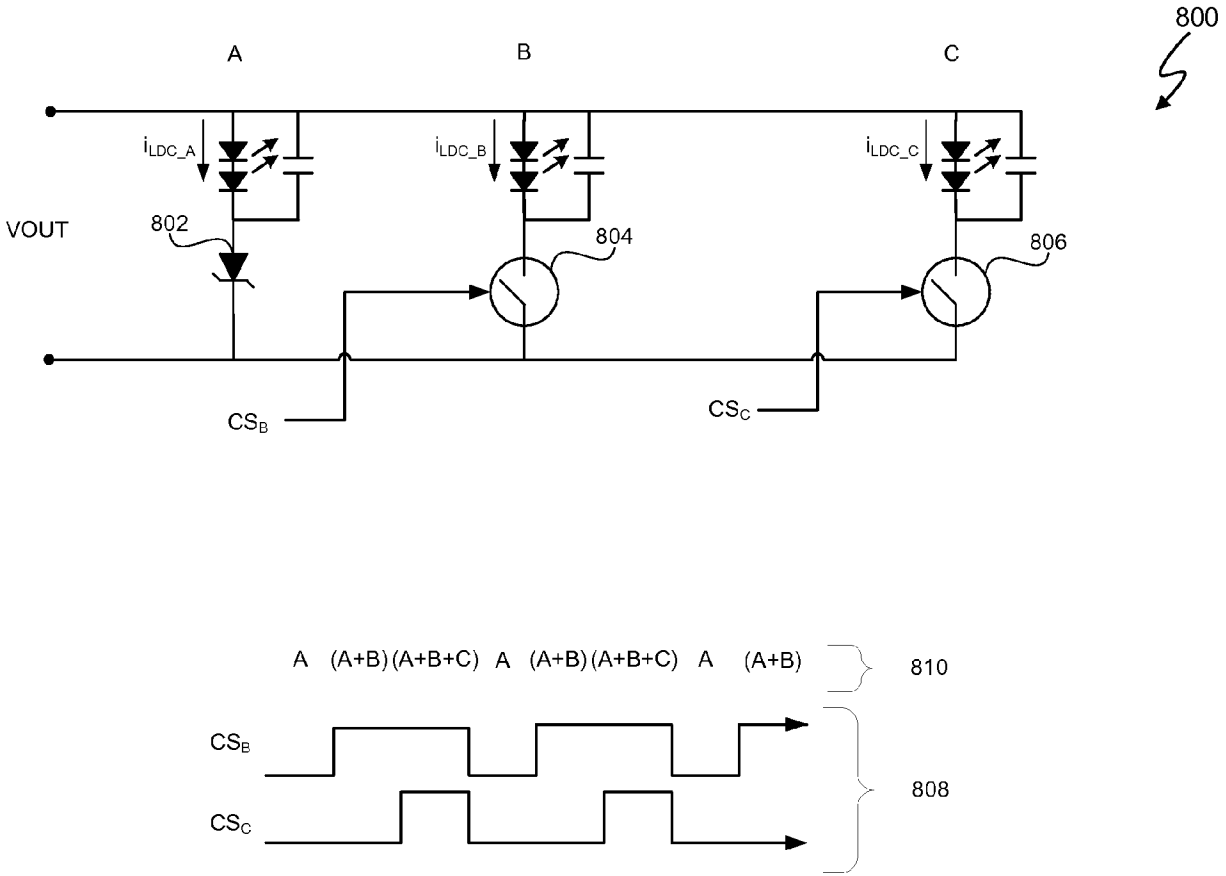
FIGS. 8-11 depict various configuration of LED emitters.

FIGS. 8-11 depict various configuration of LED emitters, which represent embodiments of LED emitters 206.1-206.N. Each of the LED emitters in FIGS. 8-11 is shown for illustrative purposes having two LEDs and illustrative control signal pulses. However, the number of LEDs in each LED emitter is a matter of design choice and can be one, two, or any desired number. Referring to FIG. 8, the LED emitter group 800 includes LED emitters A, B, and C arranged in parallel. The voltage and, thus, the drive current $i_{LDC_A}$ is held constant by Zener diode 802. Respective LED drive currents $i_{LDC_B}$ and $i_{LDC_C}$ to LED emitters B and C are controlled by respective switches 804 and 806. In at least one embodiment, switches 804 and 806 are field effect transistors (FETs) with conductivity controlled by respective control signals $CS_B$ and $CS_C$. Control signals $CS_B$ and $CS_C$ represent one embodiment of control signals CS_ILDC (FIGS. 2 and 7). In at least one embodiment, control signals $CS_B$ and $CS_C$ are pulse width modulated signals, and the duty cycle of control signals $CS_B$ and $CS_C$ is directly proportional to the brightness of respective LED emitters B and C. LED emitters A, B, and C have a color spectrum that defines a color gamut as described with reference to FIGS. 5A, 5B, and 5C. Since the brightness of LED emitter A is constant and the control signals $CS_B$ and $CS_C$ control the respective brightness of LED emitters B and C, the control signals $CS_B$ and $CS_C$ control the CCT of the light 209 emitted by the mixture of light emitted from LED emitters A, B, and C. Exemplary pulse width signals 808 generate the combinations 810 of color mixing. The contribution of brightness of LED emitter A to light 209 (FIG. 2) relative to the contribution of brightness of LED emitters B and C for a series of R pulses and each pulse having a duration of TT is:

$$B_A = \frac{TT \cdot R}{TT \cdot R + TT \cdot B + TT \cdot C}$$

wherein $B_A$ is the contribution brightness of LED emitter A to light 209, TT is the duration of each pulse of control signals $CS_B$ and $CS_C$, R is the total number of pulses of control signals $CS_B$ and $CS_C$ of a desired series of pulses, B is the number of pulses of control signal $CS_B$, and C is the number of pulses of control signal $CS_C$.

The contribution of brightness $B_B$ of LED emitter B to light 209 (FIG. 2) relative to the contribution of brightness of LED emitters A and C is:

$$B_B = \frac{TT \cdot B}{TT \cdot R + TT \cdot B + TT \cdot C}$$

The contribution of brightness $B_C$ of LED emitter C to light 209 (FIG. 2) relative to the contribution of brightness of LED emitters B and C is:

$$B_c = \frac{TT \cdot C}{TT \cdot R + TT \cdot B + TT \cdot C}$$

Figure 9:
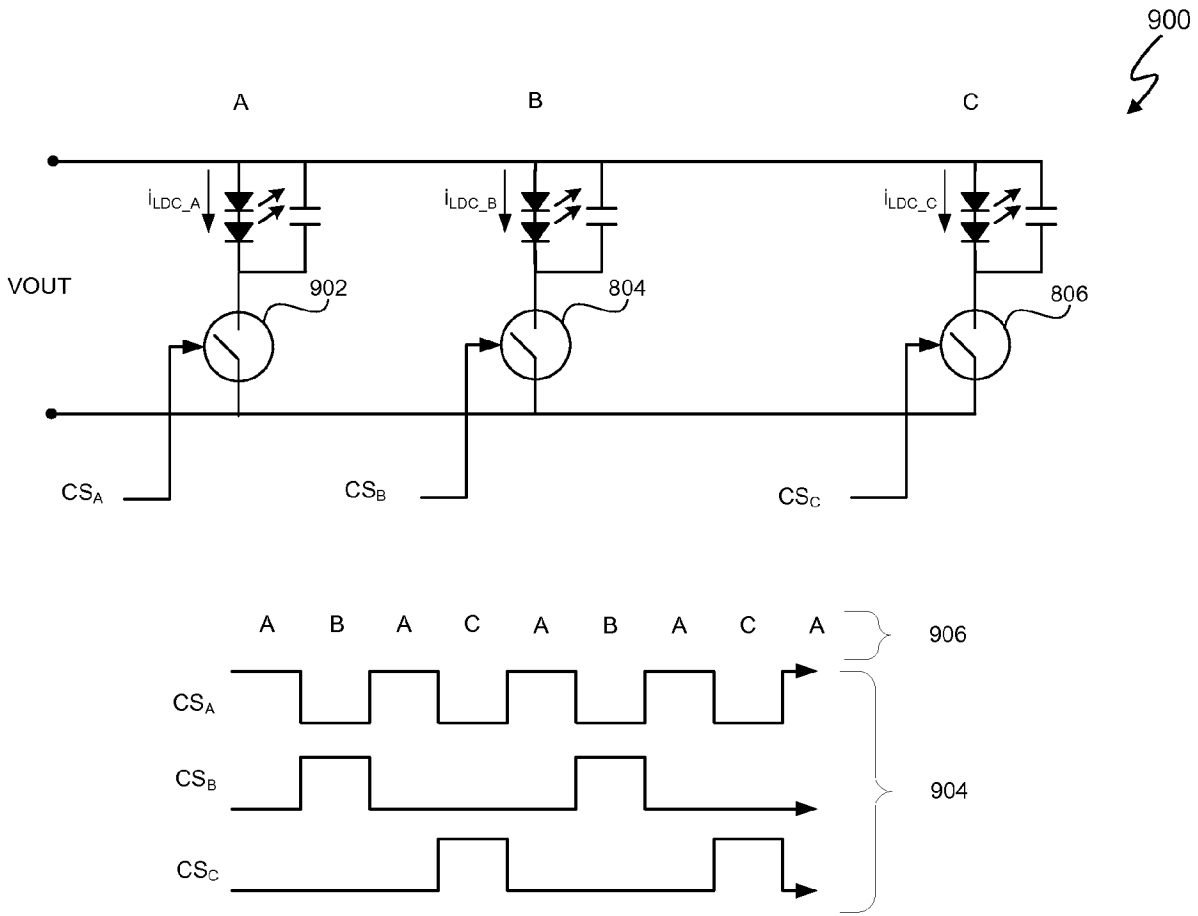

FIG. 9 depicts the LED emitter group 900 with LED emitters A, B, and C arranged in parallel. Respective LED drive currents $i_{LDC_A}$, $i_{LDC_B}$ and $i_{LDC_C}$ to LED emitters A, B, and C are controlled by respective switches 902, 804 and 806. In at least one embodiment, switch 902 is also a FET and has conductivity controlled by control signals $CS_A$. Control signals $CS_A$, $CS_B$, and $CS_C$ represent one embodiment of control signals CS_ILDC (FIGS. 2 and 7). In at least one embodiment, control signal $CS_A$ is also a pulse width modulated signal, and the duty cycle of control signals $CS_A$ is directly proportional to the brightness of LED emitter A. LED emitters A, B, and C have a color spectrum that defines a color gamut as described with reference to FIGS. 5A, 5B, and 5C. Control signals $CS_A$, $CS_B$, and $CS_C$ control the respective brightness of LED emitters A, B, and C, and, thus, the control signals $CS_A$, $CS_B$, and $CS_C$ control the CCT of the light 209 emitted by the mixture of light emitted from LED emitters A, B, and C. Exemplary pulse width signals 904 generate the combinations 906 of color mixing. The contribution of brightness of LED emitter A to light 209 (FIG. 2) relative to the contribution of brightness of LED emitters B and C for a series of R pulses and each pulse having a duration of TT is:

$$B_A = \frac{TT \cdot A}{TT \cdot A + TT \cdot B + TT \cdot C}$$

wherein $B_A$ is the contribution brightness of LED emitter A to light 209, TT is the duration of each pulse of control signals $CS_B$ and $CS_C$, B is the number of pulses of control signal $CS_B$, and C is the number of pulses of control signal $CS_C$.

The contribution of brightness $B_B$ of LED emitter B to light 209 (FIG. 2) relative to the contribution of brightness of LED emitters A and C is:

$$B_B = \frac{TT \cdot B}{TT \cdot A + TT \cdot B + TT \cdot C}$$

The contribution of brightness $B_C$ of LED emitter C to light 209 (FIG. 2) relative to the contribution of brightness of LED emitters B and C is:

$$B_c = \frac{TT \cdot C}{TT \cdot A + TT \cdot B + TT \cdot C}$$

Figure 10:
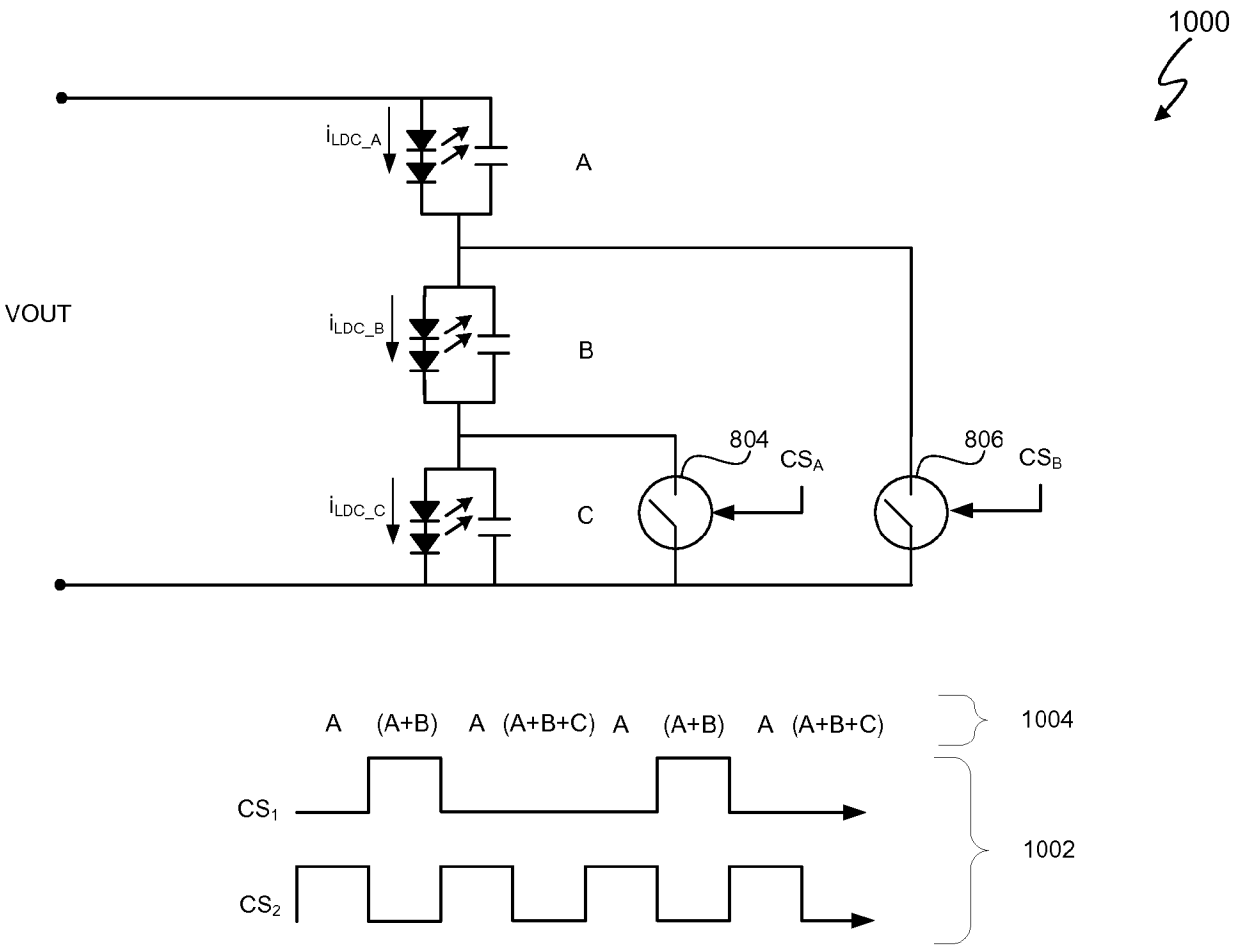

FIG. 10 depicts the LED emitter group 900 with LED emitters A, B, and C arranged in series. LED emitters A, B, and C have a color spectrum that defines a color gamut as described with reference to FIGS. 5A, 5B, and 5C. Exemplary pulse width signals 1004 generate the combinations 1004 of color mixing.

Figure 11:
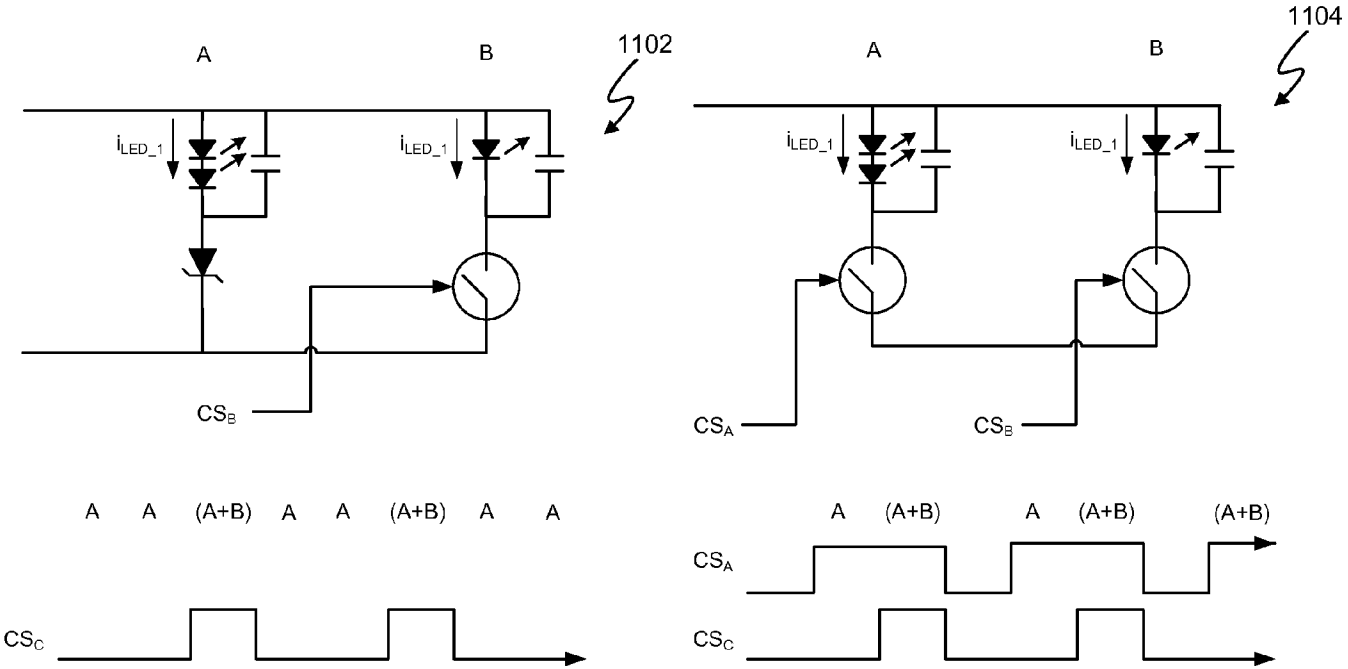

FIG. 11 depicts two LED emitter groups 1102 and 1104, each group having two LED emitters A and B. The operation of LED group 1102 is the same as LED group 800 except that LED group 1102 has two strings of LED emitters rather than three. Likewise, the operation of LED group 1104 is the same as LED group 900 except that LED group 1104 has two strings of LED emitters rather than three. LED groups 1102 and 1104 facilitate, for example, obtaining the color gamut 526 (FIG. 5B) and correlation between the dimming levels of the phase cut dimmer 203 with the black body radiation curve 504.

Referring to FIGS. 8-11, Melanson I describes the mechanism for generating the combinations of pulses of control signals $CS_A$, $CS_B$, and $CS_C$. Referring to FIGS. 2 and 7, in at least one embodiment, the LED emitter color mixing controllers 202 and 702 generate the control signals $CS_A$, $CS_B$, and $CS_C$ to apply a predetermined black body radiation function to correlate the dimming level signal DIM_LEVEL with LED drive current levels so that the color spectrum of mixed, emitted light from respective lighting systems 200 and 700 approximates a color spectrum of the predetermined black body radiation function for each value of the dimming level signal DIM_LEVEL.

Thus, a controller of a lighting system receives a phase-cut dimming level signal and controls mixing of colors of light emitted from at least two LED emitters by utilizing a predetermined black body radiation function to dynamically adjust a color spectra (i.e. dominant wavelength) of the light in response to changes in phase cut angles of the phase-cut dimming level signal.

Although embodiments have been described in detail, it should be understood that various changes, substitutions, and alterations can be made hereto without departing from the spirit and scope of the invention as defined by the appended claims.

What is claimed is:

1. An apparatus comprising:

a controller configured to:

receive a phase-cut dimming level signal; and control a first drive current to a first light emitting diode ("LED") emitter and a second drive current to a second LED emitter to control a color of mixed light emitted from the two LED emitters by responding to phase-cut angles of the dimming signal and correlating the phase-cut angles with a predetermined black body radiation function to dynamically adjust a color spectra of the mixed light in response to changes in phase cut angles of the phase-cut dimming level signal, wherein during operation of the LED emitters, the two LED emitters emit light having at least three dominant wavelengths representing at least three different colors.

2. The apparatus of claim 1 wherein the first LED emitter includes only one LED and the second LED emitter includes only one LED and to control the color of mixed light emitted from the two LED emitters further comprises to:

apply a predetermined black body radiation function to correlate the dimming level signal with at least first and second LED drive current levels;

control a first LED drive current to the first LED emitter corresponding to the first LED drive current level; and control a second LED drive current to the second LED emitter corresponding to the second LED drive current level.

3. The apparatus of claim 2 wherein the controller is further configured to apply the predetermined black body radiation function to correlate the dimming level signal with a third light emitting diode ("LED") drive current levels, and the controller is further configured to:

control a third LED drive current to a third LED emitter corresponding to the third LED drive current level, wherein during operation the first, second, and third LED emitters emit light having respective dominant wavelengths representing at least three different colors.

4. The apparatus of claim 3 wherein each dimming level signal correlates with one combination of the first, second, and third LED drive current levels.

5. The apparatus of claim 2 wherein the controller is further configured to:

respond to changes in the dimming level signal by applying the predetermined black body radiation function to re-correlate the dimming level signal with revised first and second LED drive current levels.

6. The apparatus of claim 2 wherein the controller is further configured to:

receive a selection of one or multiple predetermined black body radiation functions; and apply the selected predetermined black body radiation function to correlate the dimming level signal with the first and second LED drive current levels.

7. The apparatus of claim 2 wherein the controller is further configured to:

receive data that modifies the predetermined black body radiation function; and apply the modified predetermined black body radiation function to correlate the dimming level signal with the first and second LED drive current levels.

8. The apparatus of claim 1 wherein the controller is further configured to:

receive a selection of one or multiple predetermined black body radiation functions; and correlate the phase-cut angles with the selected predetermined black body radiation function.

9. The apparatus of claim 1 wherein the at least one controller is further configured to:

receive data that modifies the predetermined black body radiation function; and correlate the phase-cut angles with the modified predetermined black body radiation function.

10. The apparatus of claim 1 wherein the predetermined black body radiation function comprises a curve that approximates a black body radiation curve of an incandescent bulb from approximately 5,000 Kelvin to 1,500 Kelvin.

11. The apparatus of claim 1 wherein each of the dimming level signals is within one of multiple ranges of dimming level signals, and each range of dimming level signals correlates with one combination of the first and second drive current levels.

12. The apparatus of claim 1 further comprising a memory coupled to the controller, wherein the predetermined black body radiation function is represented by a map that correlates dimming level signal values to first and second LED drive current levels, the memory stores the map, and to correlate the dimming level signal with the first and second LED drive current levels, the controller is configured to:

retrieve data from the map in the memory that corresponds to the dimming level signal values.

13. The apparatus of claim 1 further comprising a memory coupled to the controller, wherein the predetermined black body radiation function is represented by an algorithm stored in the memory, and to correlate the dimming level signal values to first and second LED drive current levels, the controller is configured to:

calculate the first and second LED drive current levels using the dimming signal level and the predetermined black body radiation function.

14. The apparatus of claim 1 wherein the first LED emitter includes a first LED and also includes a lumiphor, and light exiting the first LED emitter is emitted by the LED with a first dominant wavelength corresponding to a first color and by the lumiphor with a second dominant wavelength corresponding to a second color.

15. The apparatus of claim 1 wherein to control the color of mixed light emitted from the two LED emitters further comprises to:

apply the predetermined black body radiation function to correlate the dimming level signal with two LED drive current levels.

16. The apparatus of claim 1 wherein a first of the LED emitters includes a first LED and a second LED, a second of the LED emitters includes a third LED and a fourth LED, and to control the color of mixed light emitted from the two LED emitters further comprises to:

control a first LED drive current to the first LED, wherein the first LED emits a red color;

control a second LED drive current to the second LED, wherein the second emits a blue color and also includes a lumiphor that converts part of the blue color emission from the blue LED to a green color.

17. The apparatus of claim 1 wherein the predetermined black body radiation function is non-linear.

18. The apparatus of claim 1 wherein a plurality of the phase-cut angles each correspond to different correlated color temperatures of the predetermined black body radiation function.

19. An method comprising:

receiving a phase-cut dimming level signal; and controlling a first drive current to a first light emitting diode ("LED") emitter and a second drive current to a second LED emitter to control a color of mixed light emitted from the two LED emitters by responding to phase-cut angles of the dimming signal and correlating the phase-cut angles with a predetermined black body radiation function to dynamically adjust a color spectra of the mixed light in response to changes in phase cut angles of the phase-cut dimming level signal, wherein during operation of the LED emitters, the two LED emitters emit light having at least three dominant wavelengths representing at least three different colors.

20. The method of claim 19 wherein the first LED emitter includes only one LED and the second LED emitter includes only one LED and controlling the color of mixed light emitted from the at least two LED emitters further comprises:

applying a predetermined black body radiation function to correlate the dimming level signal with at least first and second LED drive current levels;

controlling a first LED drive current to the first LED emitter corresponding to the first LED drive current level; and controlling a second LED drive current to the second LED emitter corresponding to the second LED drive current level.

21. The method of claim 20 further comprising:

applying the predetermined black body radiation function to correlate the dimming level signal with a third LED drive current levels; and controlling a third LED drive current to a third LED emitter corresponding to the third LED drive current level, wherein during operation the first, second, and third LED emitters emit light having respective dominant wavelengths representing at least three different colors.

22. The method of claim 21 wherein each dimming level signal correlates with one combination of the first, second, and third LED drive current levels.

23. The method of claim 21 further comprising:

responding to changes in the dimming level signal by applying the predetermined black body radiation function to re-correlate the dimming level signal with revised first and second LED drive current levels.

24. The method of claim 21 further comprising:

receiving a selection of one or multiple predetermined black body radiation functions; and applying the selected predetermined black body radiation function to correlate the dimming level signal with the first and second LED drive current levels.

25. The method of claim 21 further comprising:

receiving data that modifies the predetermined black body radiation function; and applying the modified predetermined black body radiation function to correlate the dimming level signal with the first and second LED drive current levels.

26. The method of claim 20 further comprising:

receiving a selection of one or multiple predetermined black body radiation functions; and correlating the phase-cut angles with the selected predetermined black body radiation function.

27. The method of claim 20 further comprising:

receiving data that modifies the predetermined black body radiation function; and correlating the phase-cut angles with the modified predetermined black body radiation function.

28. The method of claim 20 wherein the predetermined black body radiation function comprises a curve that approximates a black body radiation curve of an incandescent bulb from approximately 5,000 Kelvin to 1,500 Kelvin.

29. The method of claim 20 wherein each of the dimming level signals is within one of multiple ranges of dimming level signals, and each range of dimming level signals correlates with one combination of the first and second third LED drive current levels.

30. The method of claim 20 wherein the predetermined black body radiation function is represented by a map that correlates dimming level signal values to first and second LED drive current levels, a memory stores the map, and correlating the phase-cut angles with the first and second LED drive current levels comprises:

retrieving data from the map in the memory that corresponds to the dimming level signal values.

31. The method of claim 20 wherein the predetermined black body radiation function is represented by an algorithm stored in a memory, and correlating the phase-cut angles to first and second LED drive current levels comprises:

calculating first and second LED drive current levels using the dimming signal level and the predetermined black body radiation function.

32. The method of claim 20 wherein the first LED emitter includes a first LED and also includes a lumiphor, and light exiting the first LED emitter is emitted by the LED with a first dominant wavelength corresponding to a first color and by the lumiphor with a second dominant wavelength corresponding to a second color.

33. The method of claim 20 wherein to control the color of mixed light emitted from the two LED emitters further comprises to:

apply the predetermined black body radiation function to correlate the dimming level signal with two LED drive current levels.

34. The method of claim 20 wherein a first of the LED emitters includes a first LED and a second LED, a second of the LED emitters includes a third LED and a fourth LED, and controlling the color of mixed light emitted from the two LED emitters further comprises:

controlling a first LED drive current to the first LED, wherein the first LED emits a red color;

controlling a second LED drive current to the second LED, wherein the second emits a blue color and also includes a lumiphor that converts part of the blue color emission from the blue LED to a green color.

35. The method of claim 20 wherein the predetermined black body radiation function is non-linear.

36. The method of claim 20 wherein a plurality of the phase-cut angles each correspond to different correlated color temperatures of the predetermined black body radiation function.

37. A lighting system comprising:

a switching power converter;

at least two light emitting diode ("LED") emitters; and a controller configured to:

receive a phase-cut dimming level signal; and control a first drive current to a first light emitting diode ("LED") emitter and a second drive current to a second LED emitter to control a color of mixed light emitted from the two LED emitters by responding to phase-cut angles of the dimming signal and correlating the phase-cut angles with a predetermined black body radiation function to dynamically adjust a color spectra of the mixed light in response to changes in phase cut angles of the phase-cut dimming level signal, wherein during operation of the LED emitters, the two LED emitters emit light having at least three dominant wavelengths representing at least three different colors.

* * * * *